US011189225B1

(12) United States Patent
Heganovic et al.

(10) Patent No.: US 11,189,225 B1
(45) Date of Patent: Nov. 30, 2021

(54) PIXEL CIRCUIT WITH REDUCED SENSITIVITY TO THRESHOLD VARIATIONS OF THE DIODE CONNECTING SWITCH

(71) Applicant: Sharp Kabushiki Kaisha, Osaka (JP)

(72) Inventors: Adnan Heganovic, Oxford (GB); Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 17/029,696

(22) Filed: Sep. 23, 2020

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC ... G09G 3/3233; G09G 3/3266; G09G 3/3291
See application file for complete search history.

(56) References Cited

U.S. PATENT DOCUMENTS 7,414,599 B2 8/2008 Chung et al.
10,490,128 B1 11/2019 Qian et al.
10,714,008 B1 * 7/2020 Lu ..... G09G 3/3291

* cited by examiner

*Primary Examiner* — Stacy Khoo
(74) *Attorney, Agent, or Firm* — Renner, Otto, Boisselle & Sklar, LLP

(57) ABSTRACT

A pixel circuit that drives a light-emitting device employs a diode-connection compensation scheme that compensates for threshold variations of the diode connecting switch that diode connects the drive transistor during a threshold compensation phase. The pixel circuit operates to reduce the impact of threshold voltage variations of the diode connecting switch to improve brightness uniformity and picture quality. The pixel circuit includes two compensation capacitors in addition to the storage capacitor for data programming to control the flow and magnitude of a rebalancing current through the diode connecting switch in such a way to cancel excess or deficit of charge caused by threshold voltage variations of the diode connecting switch due to capacitive coupling between the gate node of the switch and the storage capacitor. Therefore, the circuit configuration employs a triple-capacitor structure to significantly improve compensation performance and reliability.

20 Claims, 7 Drawing Sheets

PIXEL CIRCUIT WITH REDUCED SENSITIVITY TO THRESHOLD VARIATIONS OF THE DIODE CONNECTING SWITCH

TECHNICAL FIELD

The present application relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is dictated by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another drawback of the circuit configuration of U.S. Pat. No. 7,414,599 is that the voltage variation at the VDD voltage supply line, such as the IR drop, will affect the OLED current. At the end of the data programming and compensation phase, the stored voltage across the capacitor is:

$$V_{DD_{PROG}} - (V_{DAT} - |V_{TH}|)$$

where $V_{DD_{PROG}}$ is the VDD voltage during the programming and compensation phase, which is applied to a first plate of the storage capacitor; $V_{DAT} - |V_{TH}|$ is the programmed and compensated voltage at a second plate of the storage capacitor.

The IR drop for each pixel on the same SCAN row will be different depending on the programming data voltage. Similarly, the IR drop for pixels on a different row, and therefore the VDD supply voltage $V_{DD_{PROG}}$ during programming, will be different. This difference will cause a different OLED current even with the same data signal and threshold voltage being compensated, and the uniformity of the display will be degraded by the IR drop.

Another approach is described in U.S. Ser. No. 10/490,128 (Chuang Qian, issued Nov. 26, 2019). In this configuration, two switches are used to diode connect the drive transistor. One switch is a low-temperature polycrystalline silicon (LTPS type) switch, while the second switch is an oxide type switch, such as for example and indium gallium zinc oxide (IGZO) switch. By turning off a more reliable LTPS switch, before the oxide switch is turned off, capacitive matching of the common node of the LTPS switch and the oxide switch with the drain node of the drive transistor is possible. This effectively reduces the effect of a rebalancing current on final pixel brightness of the oxide switch, and thus reduces the pixel circuit's sensitivity to threshold variations of the oxide switch. However, this solution is deficient in that the operation only cancels the rebalancing current and neglects the effect of charge injection through the parasitic capacitances of the LTPS and oxide switches. Furthermore, this technique requires an LTPO (IGZO+LTPS) process and is not viable for a pure LTPS or pure IGZO circuit.

SUMMARY OF INVENTION

The present application relates to pixel circuits that employ a diode-connection compensation scheme. Threshold variations of the diode connecting switch significantly impact the final output current, and therefore cause errors in pixel brightness and uniformity. Furthermore, main contributors to these deficiencies include two effects that take place when the diode connecting switch is turned off at the end of the threshold compensation phase. First, the diode connecting switch will conduct a current during the process of switching off, referred to as a rebalancing current, and second, charge also is injected through parasitic capacitances within the diode connecting switch. The rebalancing current and charge injection add up and significantly degrade picture uniformity and pixel reliability.

Embodiments of the present application provide a method to reduce the impact of threshold voltage variations of the diode connecting switch to improve brightness uniformity and picture quality. In exemplary embodiments, the pixel circuit includes two compensation capacitors in addition to the storage capacitor for data programming to control the flow and magnitude of the rebalancing current in such a way to cancel the excess or deficit of charge caused by threshold voltage variations of the diode connecting switch due to capacitive coupling between the gate node of the switch and the storage node. Therefore, circuit configurations of the present application employ a triple-capacitor structure to significantly improve compensation performance and reliability.

An aspect of the invention, therefore, is a pixel circuit for a display device that provides enhanced performance by performing threshold voltage compensation of a diode connecting switch transistor that diode connects the drive transistor during the compensation phase. In exemplary embodiments, the pixel circuit includes: a drive transistor configured to control an amount of current to a light-emitting device during an emission phase depending upon a voltage applied to a gate of the drive transistor, the drive transistor having a first terminal and a second terminal, with one of the first terminal or the second terminal being electrically connected during the emission phase to a first voltage supply line that supplies a driving voltage; a diode connecting second switch transistor having a first terminal connected to the gate of the drive transistor and a second terminal connected to the first or second terminal of the drive transistor, wherein during a combined threshold compensation and data programming phase, the second switch transistor is placed in an on state to diode connect the drive transistor for compensation of a threshold voltage of the drive transistor; a storage capacitor having a first plate connected to the gate of the drive transistor and a second plate opposite from the first plate; a light-emitting device that is electrically connected at a first terminal to the first or second terminal of the drive transistor during the emission phase and is connected at a second terminal to a second voltage supply line; a first compensation capacitor having a first plate connected to a gate of the second switch transistor and a second plate connected to the gate of the drive transistor; and a second compensation capacitor having a first plate connected to the first voltage supply line and a second plate connected to the second terminal of the second switch transistor. During the combined threshold compensation and data programming phase, the first and second compensation capacitors operate to compensate for threshold voltage variations of the diode connecting second switch transistor.

In exemplary embodiments, the pixel circuit includes a first switch transistor having a first terminal connected to the first voltage supply line and a second terminal connected to the first or second terminal of the drive transistor, wherein the first switch transistor is placed in an on state to electrically connect the first voltage supply line to the drive transistor; a third switch transistor having a first terminal connected to a data voltage supply line and a second terminal connected to the first or second terminal of the drive transistor, wherein the third switch transistor is placed in an on state during the combined threshold compensation and data programming phase to electrically connect the drive transistor to the data voltage supply line; a fourth switch transistor having a first terminal connected to the first or second terminal of the drive transistor and a second terminal connected to the first terminal of the light-emitting device, wherein the fourth switch transistor is placed in an on state to electrically connect the first terminal of the light-emitting device to the drive transistor; and/or a fifth switch transistor having a first terminal connected to an initialization voltage supply line that supplies an initialization voltage and a second terminal connected to the second plate of the storage capacitor, wherein the fifth switch transistor is placed in an on state during an initialization phase to electrically connect the initialization voltage supply line to the second plate of the storage capacitor.

Another aspect of the invention is a method of operating a pixel circuit in a manner that provides enhanced performance by performing threshold voltage compensation of a diode connecting switch transistor that diode connects the drive transistor during the compensation phase. In exemplary embodiments, the method of operating includes the steps of providing a pixel circuit in accordance with any of the embodiments; performing a combined threshold compensation and data programming phase to compensate a threshold voltage of the drive transistor and to program a data voltage comprising: placing the second switch transistor in an on state to diode connect the drive transistor for compensation of a threshold voltage of the drive transistor by electrically connecting a gate and the first or second terminal of the drive transistor through the second switch transistor; and electrically connecting the first or second terminal of the drive transistor to a data voltage supply line that supplies a data voltage to apply the data voltage to the first or second terminal of the drive transistor; wherein during the combined threshold compensation and data programming phase, the first and second compensation capacitors operate to compensate for threshold voltage variations of the diode connecting second switch transistor; and performing an emission phase during which light is emitted from the light-emitting device comprising: electrically connecting the drive transistor and the first power supply line; and electrically connecting the first terminal of the light-emitting device and the drive transistor to apply the driving voltage from the first voltage supply line to the light-emitting device through the drive transistor.

In exemplary embodiments, the method of operating further includes performing an on bias stress phase by placing the third switch transistor in an on state to electrically connect the drive transistor to the data voltage supply line, and applying a bias voltage from the data voltage supply line to the drive transistor through the third switch transistor. The method of operating further may include performing an initialization phase including electrically disconnecting the first terminal of the light-emitting device from the first voltage supply line; electrically connecting the second plate of the storage capacitor to an initialization voltage supply line and applying an initialization voltage to the second plate of the storage capacitor; and/or electrically connecting the first terminal of the light-emitting device to the initialization voltage supply line and applying the initialization voltage to the first terminal of the light-emitting device.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
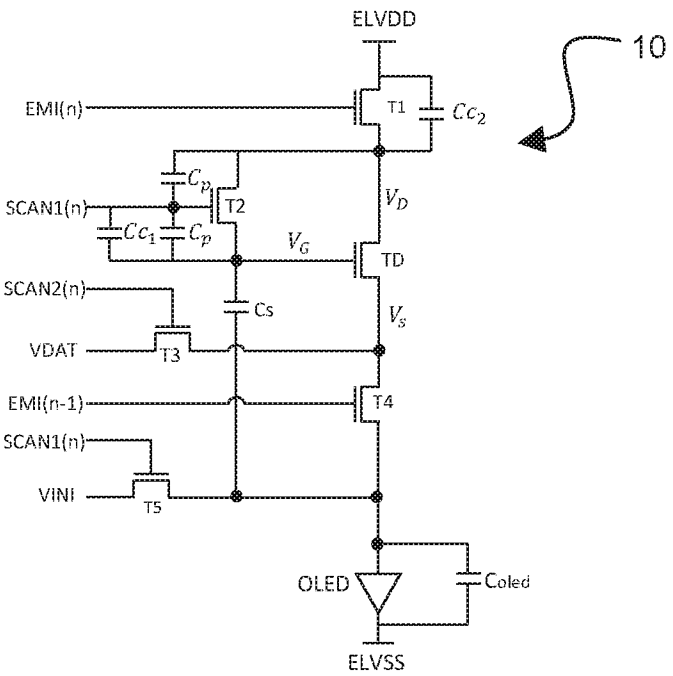
FIG. 1 is a drawing depicting a first circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
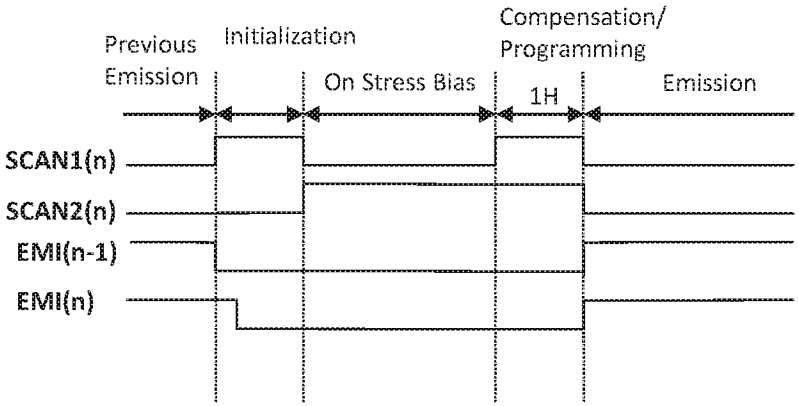
FIG. 2 is a drawing depicting a timing diagram associated with the operation of the circuit of FIG. 1.

FIG. 1 is a drawing depicting a first circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple n-type transistors TD, T1, T2, T3, T4, and T5, and three capacitors $C_s$, $C_{C1}$, and $C_{C2}$. The circuit elements drive a light-emitting device, such as for example an organic light-emitting device (OLED). The light-emitting device (OLED) has an associated internal capacitance, which is represented in the circuit diagram as $C_{oled}$. Transistor T2 also has associated parasitic capacitances, which are represented in the circuit diagram as $C_p$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple n-MOS or n-type TFTs. Transistor TD is a drive transistor that is an analogue TFT, and transistors T1-T5 are digital switch TFTs. In this exemplary embodiment of the pixel circuit, the transistors are LTPS n-type or IGZO n-type transistors. As referenced above, Cs, $C_{C1}$, and $C_{C2}$ are capacitors, with Cs also being referred to as the storage capacitor, and Cc1 and Cc2 being referred to respectively as the first and second compensation capacitors. $C_{oled}$ is the internal capacitance of the OLED device (i.e., $C_{oled}$ is not a separate component, but is inherent to the OLED). The OLED further is connected to a power supply ELVSS as is conventional. $C_p$ is the parasitic capacitance of transistor T2 (i.e., $C_p$ is not a separate component, but is inherent to T2).

The OLED and the TFT circuit 10, including the transistors, capacitors, and connecting wires, may be fabricated using TFT fabrication processes conventional in the art. It will be appreciated that comparable fabrication processes may be employed to fabricate the TFT circuits according to any of the embodiments.

For example, the TFT circuit 10 and other embodiments may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T4 and T5 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power supply ELVSS in this example. The injection layers, transport layers and emission layer may be organic materials, the first and second electrodes may be metals, and all of these layers may be deposited by a thermal evaporation technique.

Referring to the TFT circuit 10 of FIG. 1 in combination with the timing diagram of FIG. 2, the TFT circuit 10 operates to perform in four phases: an initialization phase, an on stress bias phase, a combined threshold compensation and data programming phase, and an emission phase for light emission. The time period for performing the programming phase is referred to in the art as the "one horizontal time" or "1H" time as illustrated in the timing diagram and in subsequent the timing diagrams.

For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n+1) refers to the scan signal at row n+1, and the like. EMI(n) refers to the emission signal at row n and EMI(n−1) refers to the emission signal at row n−1, and the like, and so on for the various control signals. In this manner, for the various embodiments the input signals correspond to the indicated rows.

The drive transistor TD includes a gate $V_G$, a drain $V_D$ which is also denoted the first terminal, and a source $V_S$ which also is denoted the second terminal. In this first embodiment, during the previous emission phase, the EMI(n) and EMI(n−1) signal levels have a high voltage value, so switch transistors T1 and T4 are in an on state, and light emission is being driven by the input driving voltage ELVDD being electrically connected to the drive transistor drain through T1 and the OLED being electrically connected to the drive transistor source through T4, whereby the actual current applied to the OLED is determined by the voltage between the gate node ($V_G$) and the source node ($V_S$) of the drive transistor TD. For completeness, the voltage at the drain node ($V_D$) of the drive transistor also is indicated in FIG. 1. The SCAN1 and SCAN2 signal levels for the applicable rows initially have a low voltage value so switch transistors T2, T3, and T5 are all in an off state.

Switch transistor T4 has a first terminal connected to the second terminal (source) of the drive transistor and a second terminal connected to the first terminal (anode) of the light-emitting device OLED. At the beginning of the initialization phase, the EMI(n−1) signal level is changed from a high voltage value to a low voltage value, causing switch transistor T4 to be placed in an off state.

Switch transistor T2 has a first terminal connected to the gate of the drive transistor and a second terminal connected to the first terminal (drain) of the drive transistor. Switch transistor T5 has a first terminal connected to an initialization supply line VINI that supplies an initialization voltage, and a second terminal connected to the second plate of the storage capacitor Cs and the first terminal (anode) of the light-emitting device OLED. Also during the initialization phase, the SCAN1(*n*) signal level is changed from a low voltage value to a high voltage value, causing switch transistors T2 and T5 to be placed in an on state. As transistors T2 and T5 are turned on, the supply voltage ELVDD is applied to the gate of the drive transistor TD through T2, and the initialization voltage supply line VINI is electrically connected through T5 to the first terminal (anode) of the OLED to apply the initialization voltage VINI to the anode of the OLED and to the second plate of the storage capacitor Cs. In this manner, the drive transistor gate voltage is initialized to ELVDD, and VINI is applied to the anode of the light-emitting device to reset the previous anode voltage. The voltage VINI is set to lower than the threshold voltage of the OLED plus ELVSS, and thus the VINI voltage does not cause light emission when applied at anode of the OLED. The initialization phase thereby operates to eliminate memory effects from previous frames.

Switch transistor T1 has a first terminal connected to the driving voltage supply line ELVDD, and a second terminal connected to the first terminal (drain) of the drive transistor. Also during the initialization phase, the EMI(n) signal level changes from a high voltage value to a low voltage value, which places switch transistor T1 in the off state. With both switch transistors T1 and T4 being turned off, the OLED is electrically disconnected from the drive transistor and thereby the emission driving voltage ELVDD. Toward the end of the initialization phase, the SCAN1(*n*) signal level changes from a high voltage value to a low voltage value, which places transistors T2 and T5 in the off state as the initialization process has been performed.

The circuit operation then proceeds to performing the on stress bias phase. Switch transistor T3 has a first terminal connected to a data voltage supply line VDAT that supplies a bias voltage during this phase, and a second terminal connected to the second terminal (source) of the drive transistor. During the on stress bias phase, the SCAN2(*n*) changes from a low voltage value to a high voltage value, which places switch transistor T3 in the on state. With transistor T3 turning on, the source of the drive transistor TD is electrically connected to the data voltage supply line VDAT through T3, and a bias voltage is applied from the VDAT supply line to the source of the drive transistor TD. As referenced above, from the initialization phase the gate voltage of the drive transistor is ELVDD, and thus the gate-source voltage of the drive transistor becomes ELVDD minus the bias voltage applied from VDAT. The VDAT bias voltage level during the on stress bias phase is selected to be large enough to cause an "on stress bias" to the drive transistor, which resets the drive transistor's threshold voltage shift to account for negative effects of previous frames, including memory and hysteresis effects. More specifically, the gate voltage corresponding to ELVDD typically is a relatively high positive voltage, and thus the bias voltage level during this phase is set negative to create a high-magnitude gate-source voltage of the drive transistor. Such high-magnitude gate-source voltage provides enhanced elimination of hysteresis and memory effects from previous frames.

The circuit operation then proceeds to performing the combined threshold compensation and programming phase. At the beginning of the combined threshold compensation and programming phase, the SCAN1(*n*) signal level changes from a low voltage value to a high voltage value, which places switch transistors T5 and T2 in an on state. With T5 turning on, second plate of the storage capacitor Cs is electrically connected to the initialization voltage supply line VINI through T5. With T2 turning on, the gate of the drive transistor is electrically connected to the first terminal (drain) of the drive transistor through T2. In this configuration, the drive transistor is referred to as being "diode-connected". Diode-connected refers to the drive transistor TD being operated with its gate and a second terminal (e.g., source or drain) being electrically connected, such that current flows in one direction. Accordingly, the second switch transistor T2 also is referred to as the diode connecting switch transistor.

For data programming, during this phase the voltage supplied from the data voltage supply line VDAT is updated to the data voltage value for the current frame, which is supplied to the source of the drive transistor through T3 insofar as switch transistor T3 is still in the on state. The gate voltage of the drive transistor will decrease until the gate-source voltage of the drive transistor becomes the threshold voltage $V_{thTD}$ of the drive transistor. The storage capacitor Cs has a first (top) plate connected to the gate of the drive transistor, and a second (bottom) plate connected to the first terminal (anode) of the light-emitting device OLED. The first (top) plate of the storage capacitor Cs stores in this state the voltage $V_{DAT}+V_{thTD}$. The second (bottom) plate of the storage capacitor Cs stores in this state the initialization voltage VINI being supplied through the on-state T5. Therefore, the voltage between the first and second plates of the storage capacitor Cs is:

$$V_{Cs}=V_{DAT}+V_{thTD}-V_{INI}$$

Toward the end of the combined threshold compensation and programming phase, the SCAN1($n$) signal is switched from the high voltage value to the low voltage value, which places switch transistors T2 and T5 in the off state. With T2 turning off, the drive transistor is no longer diode connected. However, the switching of T2 off does not actually occur instantaneously, as parasitic capacitances affect the switching of T2. The circuit configurations disclosed in accordance with embodiments of the current application operate to eliminate these effects, as further detailed below.

In particular, threshold variations of the diode connecting switch T2 significantly impact the final output current, and therefore cause errors in pixel brightness and uniformity. Main contributors to these deficiencies include two effects that take place when the diode connecting switch transistor is turned off at the end of the threshold compensation phase. First, the diode connecting switch will conduct a current during the process of switching off, referred to as a rebalancing current, and second, charge also is injected through parasitic capacitances within the diode connecting switch. The rebalancing current and charge injection add up and significantly degrade picture uniformity and pixel reliability.

As further detailed below, embodiments of the present application provide a method to reduce the impact of threshold voltage variations of the diode connecting switch to improve brightness uniformity and picture quality. In exemplary embodiments, the pixel circuit includes two compensation capacitors, in addition to the storage capacitor for data programming, to control the flow and magnitude of the rebalancing current in such a way to cancel the excess or deficit of charge caused by threshold voltage variations of the diode connecting switch due to capacitive coupling between the gate node of the switch and the storage node. Therefore, circuit configurations of the present application employ a triple-capacitor structure to significantly improve compensation performance and reliability.

When transistor T2 is turned off, as SCAN1($n$) transitions from a high to a low state due to capacitive coupling between the gate of T2 and the drain and gate of the drive transistor through Cp, the gate node voltage is pulled down. Therefore, the voltage stored on the storage capacitor after T2 is closed is:

$$V_{Cs}=V_{DAT}+V_{thTD}-V_{INI}-V_{T2}$$

where $V_{T2}$ represents the voltage change on the gate node of the drive transistor that occurs due to the pull down caused by said capacitive coupling. However, the value of $V_{T2}$ is not constant and varies with the threshold voltage $V_{thT2}$ of the switch transistor T2 due to two effects. The first effect is the rebalancing current that occurs as a voltage difference between the two conducting terminals of T2 builds up and causes a current through T2. The second effect is charge ejection through Cp, which varies with the threshold voltage of T2 since the value of Cp itself depends on the threshold $V_{thT2}$ of T2. Therefore, $V_{T2}$ is a function of the threshold voltage $V_{thT2}$:

$$V_{Cs}=V_{DAT}+V_{thTD}-V_{INI}-V_{T2(V_{thT2})}$$

Figure 3:
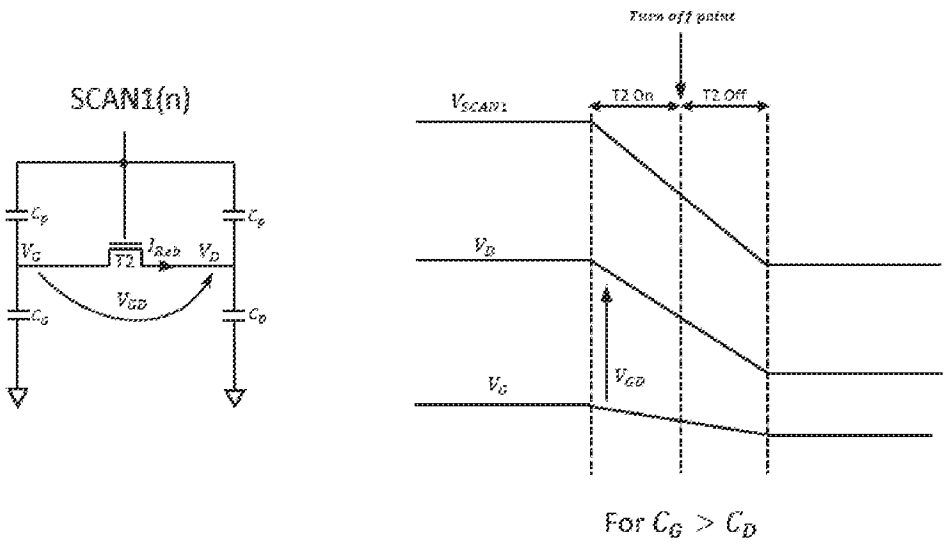
FIG. 3 is a drawing depicting the effect of a detrimental rebalancing current through the diode connecting switch transistor.

FIG. 3 illustrates a first parasitic effect when T2 is turned off in the generation of a rebalancing current $I_{Reb}$. FIG. 3 illustrates the cause and the direction of the rebalancing current. Referring to the left side portion of FIG. 3, since the total capacitance $C_G$ of node $V_G$ (gate of the drive transistor) is higher than the total capacitance $C_D$ of node $V_D$ (drain of the drive transistor), charge is transferred through T2 from node $V_G$ to node $V_D$, i.e., the rebalancing current flows from the drive transistor gate $V_G$ to the drive transistor drain $V_D$. As shown in the right side portion of FIG. 3, if transistor T2 needs a longer time to turn off (the turnoff point is indicated in the figure relative to the SCAN1 signal change) due to a negative threshold shift $V_{thT2}$, the duration of the rebalancing current flowing through T2 is increased and consequently less charge is stored on the gate node $V_G$. That charge difference can be expressed as a voltage and is approximately:

$$\Delta V_{G_Ireb} \approx \Delta V_{thT2} \frac{\frac{C_G}{C_D}-1}{\frac{C_G}{C_D}+1} \frac{C_{p_on}}{C_G}$$

where $C_{p_on}$ is the $C_p$ parasitic capacitance of T2 while T2 is in the on state, and $\Delta V_{G_Ireb}$ is a change of the gate voltage of the drive transistor caused by the change of the rebalancing current. The change of rebalancing current is caused by a change in the threshold voltage $\Delta V_{thT2}$ of transistor T2.

Figure 4:
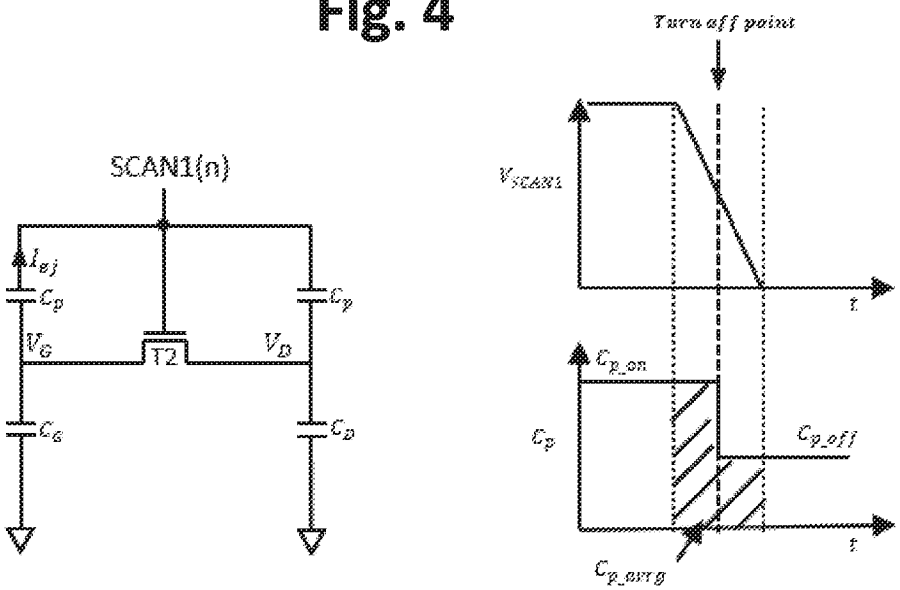
FIG. 4 is a drawing depicting the effect of a detrimental charge injection through parasitic capacitances of the diode connecting switch transistor.

FIG. 4 illustrates a second parasitic effect when T2 is turned off in the generation of a charge injection to the parasitic capacitance Cp of T2. The left side portion of FIG. 4 illustrates that with the charge injection to Cp, an ejection current is generated from the node $V_G$ toward the SCAN1($n$) signal line, denoted in FIG. 4 by the ejection current $I_{ej}$. The right side portion of FIG. 4 illustrates how the ejection current through Cp changes with the threshold voltage of diode connecting switch transistor T2. If transistor T2 needs a longer time to turn off (again, the turnoff point is indicated in the figure relative to the SCAN1 signal change) due to threshold variations $V_{thT2}$, the average parasitic capacitance $C_{p_avrg}$ is increased, and consequently more charge is ejected from drive transistor gate node $V_g$ to SCAN1($n$) through $C_p$. That difference in charge can be expressed as a voltage and is approximately:

$$\Delta V_{G_cvar} \approx \Delta V_{thT2} \frac{C_{p_on}-C_{p_off}}{C_{GTot}}$$

where $C_{p_off}$ is off the parasitic capacitance of T2 when T2 is in the off state, and $\Delta V_{G_cvar}$ is a change of the gate voltage of the drive transistor caused by the change of charge ejection. The change of the charge ejection is caused by a change in the threshold voltage $\Delta V_{thT2}$ of transistor T2.

FIGS. 3 and 4, therefore, illustrate two parasitic effects that occur as diode connecting switch transistor T2 is turned off during the combined threshold compensation and programming phase. The first effect is the rebalancing current as illustrated in FIG. 3, and the second effect is the charge injection and resultant ejection current as illustrated in FIG. 4. Both effects reduce the amount of charge stored at the gate $V_G$ of the drive transistor with a negative shift in threshold voltage $V_{thT2}$ of T2 and vice versa, and accordingly these two effects combine together and may significantly deteriorate the reliability of the pixel circuit based on variations in the threshold voltage of the diode connecting switch transistor. The sum of these parasitic effects is:

$$\Delta V_{T2(V_{thT2})}=\Delta V_{G_total}=\Delta V_{G_reb}+\Delta V_{G_cvar}$$

To substantially reduce or eliminate the two parasitic effects described above, the pixel circuit 10 further is configured to alter the magnitude and direction of the rebalancing current $I_{Reb}$ essentially to cancel out the ejection current $I_{ej}$. In this manner, the combined effect is negation of the ejection current by the rebalancing current, meaning the overall current effect of the two now-opposing currents is nil. The change in the magnitude and direction of the rebalancing current is achieved by the addition of the two compensation capacitors Cc1 and Cc2. As depicted in the circuit diagram of FIG. 1, first compensation capacitor Cc1 has a first (top) plate connected a node corresponding to the SCAN1 signal line and a gate of the diode connecting switch transistor T2, and a second (bottom) plate connected to a node corresponding to the second terminal of T2 and the gate of the drive transistor. Second compensation capacitor Cc2 has a first (top) plate connected to a node corresponding to the voltage input supply line ELVDD and the first terminal of switch transistor T1, and a second (bottom) plate connected to a node corresponding to the first terminal of T2 and the first terminal (drain) of the drive transistor TD.

Figure 5:
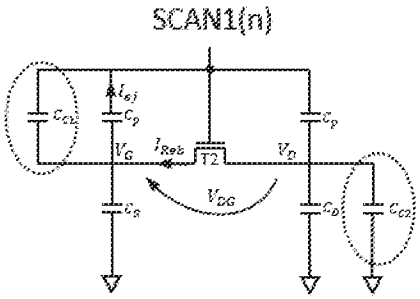
FIG. 5 is a drawing depicting the effect first and second compensation capacitors on the rebalancing current and charge injection.
Figure 5:
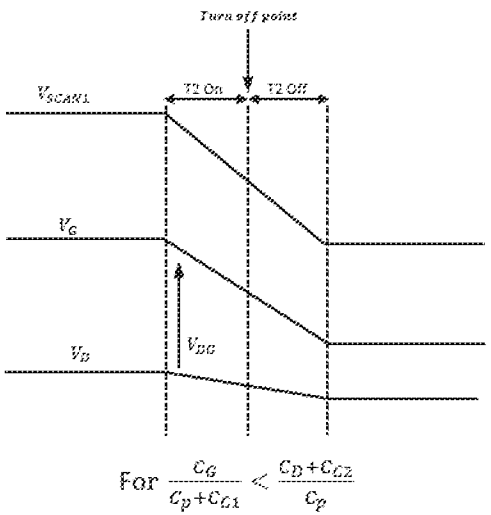

FIG. 5 shows how compensation capacitors Cc1 and Cc2 change the direction of the rebalancing current. The rebalancing current now supplies an excess charge to the drive transistor gate $V_g$ for a negative shift $V_{thT2}$ of T2. The capacitive coupling from $V_g$ to SCAN1(*n*) through $C_p$ creates a charge deficit for a negative shift $V_{thT2}$ of T2. If the excess charge caused by the rebalancing current is matching the loss of charge due to capacitive coupling between $V_g$ and SCAN1(*n*), then threshold variations $V_{thT2}$ of T2 no longer impact the final voltage value of the drive transistor gate $V_g$. Assuming $C_{p_on}>C_{p_off}$ the voltage change of $V_g$ due to threshold variations $V_{thT2}$ becomes:

$$\Delta V_{T2(V_{thT2})} \approx \Delta V_{thT2} \frac{C_{p_on}}{C_G}\left(\frac{\frac{C_G}{C_D+C_{C2}} - \frac{C_{p_on}+C_{C1}}{C_{p_on}}}{\frac{C_G}{C_D+C_{C2}}+1}+1\right)$$

which yields the following condition:

$$\Delta V_{T2(V_{thT2})} \approx 0 \text{ for } C_{C2} \approx \frac{2C_{p_on}}{C_{C1}} C_G - C_D$$

For this condition $V_{T2}$ is independent of $V_{thT2}$, and therefore the voltage stored on the storage capacitor Cs is:

$$V_{C1}=V_{DAT}+V_{thTD}-V_{INI}-V_{T2}$$

In other words, the term for the threshold voltage of the diode connecting switch transistor T2, $V_{thT2}$, falls out and thus the detrimental effects of the rebalancing current and the charge ejection current have been negated. The resultant threshold compensation of the drive transistor is therefore achieved without being undermined by said detrimental effects of the threshold voltage variations of the diode connecting transistor T2 in view of the rebalancing current and the charge ejection current. The compensation capacitors Cc1 and Cc2 are sized in such a way to generate a magnitude of the rebalancing current such that the two effects of the rebalancing current and the charge ejection current, which occur while T2 is being switched off, essentially cancel each other out.

As referenced above, the compensation phase is combined with the programming phase in which the data for the current frame is programmed. With the SCAN2(*n*) signal level being high at the beginning of the combined threshold compensation and programming phase, the data value for the current frame is applied to the second terminal (source) of the drive transistor from the data voltage supply line VDAT through the on-state T3. At the end of the combined threshold compensation and programming phase, SCAN2(*n*) changes from a high voltage value to a low voltage value, which places T3 in the off state. As transistor T3 is turned off, the data voltage supply line VDAT is electrically disconnected from the source of the drive transistor to complete the programming operation.

The pixel circuit next is operational in an emission phase during which the light-emitting device emits light. During the emission phase, the signals EMI(n−1) and EMI(n) are changed from a low voltage value to a high voltage value, which places switch transistors T1 and T4 in the on state. As transistor T1 is turned on, the first terminal (drain) of the drive transistor is electrically connected through T1 to the power supply line that supplies the driving voltage ELVDD. As transistor T4 is turned on, the second terminal (source) of the drive transistor is electrically connected through T4 to the first terminal (anode) of the OLED. The current that flows through the OLED is:

$$I_{OLED} = \frac{\beta}{2}(V_{DAT} + V_{thTD} - V_{INI} - V_{T2} - V_{thTD})^2$$

$$I_{OLED} = \frac{\beta}{2}(V_{DAT} - V_{INI} - V_{T2})^2$$

where $$\beta = \mu_n \cdot C_{ox} \cdot \frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TD, and hence the current to the OLED device $I_{OLED}$ is not affected by the threshold voltage variations of the drive transistor. In this manner, variation in the threshold voltage of the drive transistor has been compensated. In addition, as detailed above the addition of the compensation capacitors Cc1 and Cc2 operates to significantly reduce the effect of the threshold variations of the diode connecting switch transistor T2 to increase reliability and picture uniformity. As referenced above, the compensation capacitors Cc1 and Cc2 are sized in such a way to generate a magnitude of the rebalancing current such that the two effects of the rebalancing current and the charge ejection current, which occur while T2 is being switched off, essentially cancel each other out.

Figure 6:
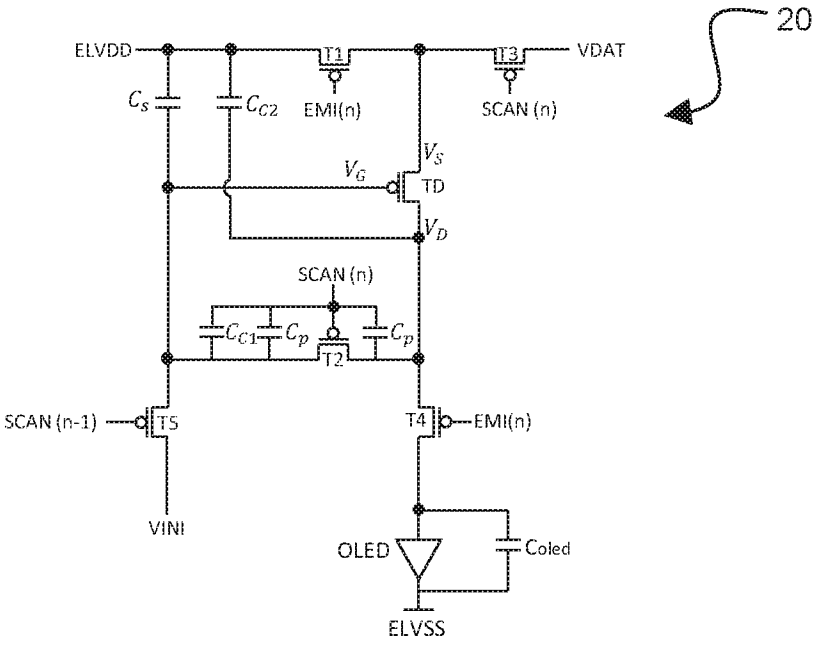
FIG. 6 is a drawing depicting a second circuit configuration in accordance with embodiments of the present application.
Figure 7:
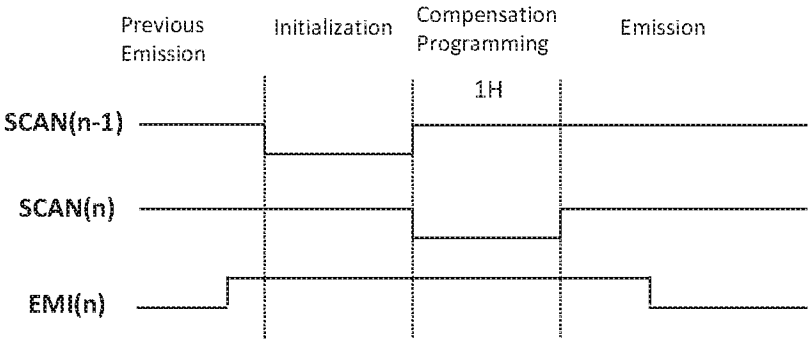
FIG. 7 is a drawing depicting a timing diagram associated with the operation of the circuit of FIG. 6.

FIG. 6 is a drawing depicting a second circuit configuration 20 in accordance with embodiments of the present application, and FIG. 7 is a timing diagram associated with the operation of the circuit configuration 20 of FIG. 6. The circuit configuration 20 of FIG. 6 operates comparably as the circuit configuration 10 of FIG. 1, except that the circuit configuration 20 employs p-type transistors rather than n-type transistors. As is known in the art, the drive properties of a particular OLED may be more suitable for one or other of p-type versus n-type transistors, and the principles of the present application are applicable to either type of configuration.

Accordingly, in this example, the circuit 20 is configured as a TFT circuit that includes multiple p-type transistors (T1, T2, T3, T4, T5, and TD). In this embodiment, there again are three capacitors, Cs, Cc1, and Cc2, whereby Cc1 and Cc2 are first and second compensation capacitors that operate to negate the effects of variations of the threshold voltage of the diode-connecting switch transistor T2 in view of the rebalancing and ejection currents when T2 is turned off. The circuit elements drive a light-emitting device, such as for example an OLED. The light-emitting device (OLED) has an associated internal capacitance, which again is represented in the circuit diagram as $C_{oled}$. The OLED further is connected to the power supply ELVSS as is conventional. In addition, although the embodiments are described principally in connection with an OLED as the light-emitting device, comparable principles may be used with display technologies that employ other types of light-emitting devices, including for example micro LEDs and quantum dot LEDs. Similarly as in the previous embodiment, TD is a drive transistor that is an analogue TFT, and T1, T2, T3, T4, and T5 are digital switch TFTs.

Referring to the TFT circuit 20 in combination with the timing diagram of FIG. 7, the TFT circuit 20 operates to perform in three phases: an initialization phase, a combined threshold compensation and programming phase, and an emission phase for light emission. In this second embodiment, the additional on stress bias phase is optionally omitted. The control signal levels depicted in the timing diagram of FIG. 7 are basically comparable to the control signal levels depicted in the timing diagram of FIG. 2, except modified as warranted for the operation of p-type transistors rather than n-type transistors. During the previous emission phase, the EMI(n) signal level has a low voltage value, so switch transistors T1 and T4 are placed in the on state, and light emission is being driven by the input voltage ELVDD being electrically connected to the drive transistor TD through T1 and to the OLED through T4, whereby the actual current applied to the OLED is determined by the voltage at the gate of the drive transistor. The various SCAN(n) and the SCAN(n−1) signal levels initially have a high voltage value so transistors T2, T3, and T5 are in the off state.

At the beginning of the initialization phase, the EMI(n) signal level is changed from the low voltage value to the high voltage value, causing transistors T1 and T4 to be turned off to cease light emission. In the circuit configuration 20 employing p-type transistors, switch transistor T5 has a first terminal connected to an initialization supply line VINI that supplies an initialization voltage, and a second terminal connected to the gate of the drive transistor as well as to the second plate of the storage capacitor Cs. Also during the initialization phase, the SCAN(n−1) signal level is changed from the high voltage value to the low voltage value turning transistor T5 on to electrically connect the gate of the drive transistor to the initialization voltage supply line, and the initialization voltage is applied to the gate of the drive transistor and to the second plate of the storage capacitor through switch T5. At the end of the initialization phase, the SCAN(n−1) signal level is changed from the low voltage value to the high voltage, turning transistor T5 as the gate voltage of the drive transistor has been initialized by VINI.

At the beginning of the combined threshold compensation and programming phase, the SCAN(n) signal level is changed from the high voltage value to the low voltage value, turning transistors T2 and T3 on. With T2 turning one, the drive transistor becomes diode connected through T2 for threshold compensation of the drive transistor, and with T3 turning on, the data voltage is applied from the data voltage supply line VDAT to the source of the drive transistor through T3 to program the data for current frame. In the embodiment employing p-type transistors, the storage capacitor Cs has a first (top) plate connected to the power supply line that supplies ELVDD, and a second (bottom) plate connected to the gate of the drive transistor TD. The drive transistor will source a current to node $V_G$ until the stored voltage on $V_G$ reaches the following voltage value:

$$V_G = V_{DAT} - V_{thTD}$$

At the end of the combined threshold compensation and programming phase, the SCAN(n) signal level changes from a low voltage value to a high voltage value, causing transistors T2 and T3 to be turned off. As transistor T2 is being turned off, similarly to the previous embodiment, a rebalancing current flows through transistor T2, and charge is being injected into the drive transistor gate node $V_G$ through transistor T2's parasitic capacitance $C_p$. After T2 is turned off, the node voltage of $V_G$ has the following value:

$$V_G = V_{DAT} - V_{thTD} - V_{T2(V_{thT2})}$$

Similarly to the previous embodiment, compensation capacitors Cc1 and Cc2 operate to change the magnitude and direction of the rebalancing current to cancel the loss of charge due to capacitive coupling between SCAN(n) and $V_G$ through $C_p$. Therefore, the change of voltage $V_{T2}$ caused by the switching off process of the diode connecting switch T2 is independent of the T2's threshold voltage $V_{thT2}$. The node voltage of $V_G$ is therefore:

$$V_G = V_{DAT} - V_{thTD} - V_{T2}$$

The stored voltage on the storage capacitor is:

$$V_{C_s} = V_{ELVDD} - V_{DAT} + V_{thTD} + V_{T2}$$

In this manner, the resultant threshold compensation of the drive transistor again is achieved without circuit performance being undermined by said detrimental effects of the threshold voltage variations of the diode connecting transistor T2 in view of the rebalancing current and the charge ejection current. Again, the compensation capacitors Cc1 and Cc2 are sized to generate a magnitude of the rebalancing current such that the two effects of the rebalancing current and the charge ejection current, which occur while T2 is being switched off, essentially cancel each other out.

At the beginning of the emission phase, the EMI(n) signal level is changed from a high voltage value to a low voltage value, turning transistors T1 and T4 on. A current flows through the OLED that is determined by the gate-source voltage of the drive transistor. Therefore, the current through the OLED is:

$$I_{OLED} = \frac{\beta}{2}(V_{ELVDD} - V_{DAT} + V_{thTD} + V_{T2} - V_{thTD})^2$$

$$I_{OLED} = \frac{\beta}{2}(V_{ELVDD} - V_{DAT} + V_{T2})^2$$

where $$\beta = \mu_n \cdot C_{ox} \cdot \frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Similarly as in the previous embodiment, the current to the OLED does not depend on the threshold voltage of the drive transistor TD, and hence the current to the OLED device $I_{OLED}$ is not affected by the threshold voltage variations of the drive transistor. In this manner, variation in the threshold voltage of the drive transistor has been compensated.

An aspect of the invention, therefore, is a pixel circuit for a display device that provides enhanced performance by performing threshold voltage compensation of a diode connecting switch transistor that diode connects the drive transistor during the compensation phase. In exemplary embodiments, the pixel circuit includes: a drive transistor configured to control an amount of current to a light-emitting device during an emission phase depending upon a voltage applied to a gate of the drive transistor, the drive transistor having a first terminal and a second terminal, with one of the first terminal or the second terminal being electrically connected during the emission phase to a first voltage supply line that supplies a driving voltage; a diode connecting second switch transistor having a first terminal connected to the gate of the drive transistor and a second terminal connected to the first or second terminal of the drive transistor, wherein during a combined threshold compensation and data programming phase, the second switch transistor is placed in an on state to diode connect the drive transistor for compensation of a threshold voltage of the drive transistor; a storage capacitor having a first plate connected to the gate of the drive transistor and a second plate opposite from the first plate; a light-emitting device that is electrically connected at a first terminal to the first or second terminal of the drive transistor during the emission phase and is connected at a second terminal to a second voltage supply line; a first compensation capacitor having a first plate connected to a gate of the second switch transistor and a second plate connected to the gate of the drive transistor; and a second compensation capacitor having a first plate connected to the first voltage supply line and a second plate connected to the second terminal of the second switch transistor. During the combined threshold compensation and data programming phase, the first and second compensation capacitors operate to compensate for threshold voltage variations of the diode connecting second switch transistor. The pixel circuit may include one or more of the following features, either individually or in combination.

In an exemplary embodiment of the pixel circuit, the pixel circuit further includes a first switch transistor having a first terminal connected to the first voltage supply line and a second terminal connected to the first or second terminal of the drive transistor, wherein the first switch transistor is placed in an on state to electrically connect the first voltage supply line to the drive transistor.

In an exemplary embodiment of the pixel circuit, the pixel circuit further includes a third switch transistor having a first terminal connected to a data voltage supply line and a second terminal connected to the second terminal of the drive transistor, wherein the third switch transistor is placed in an on state during the combined threshold compensation and data programming phase to electrically connect the drive transistor to the data voltage supply line.

In an exemplary embodiment of the pixel circuit, the pixel circuit further includes a fourth switch transistor having a first terminal connected to the first or second terminal of the drive transistor and a second terminal connected to the first terminal of the light-emitting device, wherein the fourth switch transistor is placed in an on state to electrically connect the first terminal of the light-emitting device to the drive transistor.

In an exemplary embodiment of the pixel circuit, the pixel circuit further includes a fifth switch transistor having a first terminal connected to an initialization voltage supply line that supplies an initialization voltage and a second terminal connected to the storage capacitor, wherein the fifth switch transistor is placed in an on state during an initialization phase to electrically connect the storage capacitor to the initialization voltage supply line.

In an exemplary embodiment of the pixel circuit, the second plate of the storage capacitor is connected to the first terminal of the light-emitting device.

In an exemplary embodiment of the pixel circuit, the second terminal of the fifth switch transistor further is connected to the first terminal of the light-emitting device, wherein the fifth switch transistor is placed in an on state during the initialization phase to electrically connect the first terminal of the light-emitting device to the initialization voltage supply line.

In an exemplary embodiment of the pixel circuit, the pixel circuit is further operable in an on stress bias phase, wherein the third switch transistor is placed in the on state during the on stress bias phase to apply a bias voltage from the data voltage supply line to the drive transistor.

In an exemplary embodiment of the pixel circuit, the transistors are n-type transistors.

In an exemplary embodiment of the pixel circuit, the second plate of the storage capacitor is connected to the first voltage supply line.

In an exemplary embodiment of the pixel circuit, the second terminal of the fifth switch transistor further is connected to the first plate of the storage capacitor and the gate of the drive transistor, and during the initialization phase the initialization gate of the drive transistor is electrically connected to the initialization voltage supply line.

In an exemplary embodiment of the pixel circuit, the transistors are p-type transistors.

In an exemplary embodiment of the pixel circuit, the light-emitting device is one of an organic light-emitting diode, a micro light-emitting diode (LED), or a quantum dot LED.

Another aspect of the invention is a method of operating a pixel circuit in a manner that provides enhanced performance by performing threshold voltage compensation of a diode connecting switch transistor that diode connects the drive transistor during the compensation phase. In exemplary embodiments, the method of operating includes the steps of providing a pixel circuit in accordance with any of the embodiments; performing a combined threshold compensation and data programming phase to compensate a threshold voltage of the drive transistor and to program a data voltage comprising: placing the second switch transistor in an on state to diode connect the drive transistor for compensation of a threshold voltage of the drive transistor by electrically connecting a gate and the first or second terminal of the drive transistor through the second switch transistor; and electrically connecting the first or second terminal of the drive transistor to a data voltage supply line that supplies a data voltage to apply the data voltage to the first or second terminal of the drive transistor; wherein during the combined threshold compensation and data programming phase, the first and second compensation capacitors operate to compensate for threshold voltage variations of the diode connecting second switch transistor; and performing an emission phase during which light is emitted from the light-emitting device comprising: electrically connecting the drive transistor and the first power supply line; and electrically connecting the first terminal of the light-emitting device and the drive transistor to apply the driving voltage from the first voltage supply line to the light-emitting device through the drive transistor. The method of operating may include one or more the following features, either individually or in combination.

In an exemplary embodiment of the method of operating, the combined threshold compensation and data programming phase further includes placing the third switch transistor in an on state to electrically connect the drive transistor to the data voltage supply line to supply the data voltage through the third switch transistor.

In an exemplary embodiment of the method of operating, the method further includes performing an on stress bias phase by placing the third switch transistor in an on state to electrically connect the drive transistor to the data voltage supply line, and applying a bias voltage from the data voltage supply to the drive transistor through the third switch transistor.

In an exemplary embodiment of the method of operating, the emission phase further includes placing the fourth switch transistor in an on state to electrically connect the first terminal of the light-emitting device to the drive transistor through the fourth switch transistor.

In an exemplary embodiment of the method of operating, the method further includes performing an initialization phase including electrically disconnecting the first terminal of the light-emitting device from the first voltage supply line, and electrically connecting the second plate of the storage capacitor to an initialization voltage supply line and applying an initialization voltage to the second plate of the storage capacitor.

In an exemplary embodiment of the method of operating, the initialization phase further includes electrically connecting the first terminal of the light-emitting device to the initialization voltage supply line and applying the initialization voltage to the first terminal of the light-emitting device.

In an exemplary embodiment of the method of operating, the initialization phase includes placing the fifth switch transistor in an on state and applying the initialization voltage from the initialization voltage supply line through the fifth switch transistor.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
20—second circuit configuration
T1-T5—multiple switch transistors
TD—drive transistor
OLED—organic light emitting diode (or generally light-emitting device)
Cs—storage capacitor
Cc1—first compensation capacitor
Cc2—second compensation capacitor
$C_p$—parasitic capacitance of transistor T2
$C_{p_on}$—parasitic capacitance of transistor T2 when T2 is on
$C_{p_off}$—parasitic capacitance of transistor T2 when T2 is off
$C_{oled}$—internal capacitance of OLED
$V_G$—gate of drive transistor in the pixel circuit
$V_D$—drain of drive transistor in the pixel circuit
$V_S$—source of drive transistor in the pixel circuit
VDAT—data voltage and supply line
ELVDD—first power supply and supply line
ELVSS—second power supply and supply line
VINI—initialization voltage and supply line
SCAN1/SCAN2/EMI—control signals

What is claimed is:

1. A pixel circuit for a display device comprising:

a drive transistor configured to control an amount of current to a light-emitting device during an emission phase depending upon a voltage applied to a gate of the drive transistor, the drive transistor having a first terminal and a second terminal, with one of the first terminal or the second terminal being electrically connected during the emission phase to a first voltage supply line that supplies a driving voltage;

a diode connecting first switch transistor having a first terminal connected to the gate of the drive transistor and a second terminal connected to the first terminal of the drive transistor, wherein during a combined threshold compensation and data programming phase, the first switch transistor is placed in an on state to diode connect the drive transistor for compensation of a threshold voltage of the drive transistor;

a storage capacitor having a first plate connected to the gate of the drive transistor and a second plate opposite from the first plate;

a light-emitting device that is electrically connected at a first terminal to the first or second terminal of the drive transistor during the emission phase and is connected at a second terminal to a second voltage supply line;

a first compensation capacitor having a first plate connected to a gate of the first switch transistor and a second plate connected to the gate of the drive transistor; and a second compensation capacitor having a first plate connected to the first voltage supply line and a second plate connected to the second terminal of the first switch transistor;

wherein during the combined threshold compensation and data programming phase, the first and second compensation capacitors operate to compensate for threshold voltage variations of the diode connecting first switch transistor.

2. The pixel circuit of claim 1, further comprising a second switch transistor having a first terminal connected to the first voltage supply line and a second terminal connected to the first or second terminal of the drive transistor, wherein the second switch transistor is placed in an on state to electrically connect the first voltage supply line to the drive transistor.

3. The pixel circuit of claim 1, further comprising a second switch transistor having a first terminal connected to a data voltage supply line and a second terminal connected to the second terminal of the drive transistor, wherein the second switch transistor is placed in an on state during the combined threshold compensation and data programming phase to electrically connect the drive transistor to the data voltage supply line.

4. The pixel circuit of claim 3, further comprising a third switch transistor having a first terminal connected to the first or second terminal of the drive transistor and a second terminal connected to the first terminal of the light-emitting device, wherein the third switch transistor is placed in an on state to electrically connect the first terminal of the light-emitting device to the drive transistor.

5. The pixel circuit of claim 4, further comprising a fourth switch transistor having a first terminal connected to an initialization voltage supply line that supplies an initialization voltage and a second terminal connected to the storage capacitor, wherein the fourth switch transistor is placed in an on state during an initialization phase to electrically connect the storage capacitor to the initialization voltage supply line.

6. The pixel circuit of claim 1, wherein the second plate of the storage capacitor is connected to the first terminal of the light-emitting device.

7. The pixel circuit of claim 5, wherein the second terminal of the fourth switch transistor further is connected to the first terminal of the light-emitting device, wherein the fourth switch transistor is placed in an on state during the initialization phase to electrically connect the first terminal of the light-emitting device to the initialization voltage supply line.

8. The pixel circuit of claim 3, wherein the pixel circuit is further operable in an on stress bias phase, wherein the second switch transistor is placed in the on state during the on stress bias phase to apply a bias voltage from the data voltage supply line to the drive transistor.

9. The pixel circuit of claim 1, wherein the transistors are n-type transistors.

10. The pixel circuit of claim 7, wherein the second plate of the storage capacitor is connected to the first voltage supply line.

11. The pixel circuit of claim 10, wherein the second terminal of the fourth switch transistor further is connected to the first plate of the storage capacitor and the gate of the drive transistor, and during the initialization phase the gate of the drive transistor is electrically connected to the initialization voltage supply line.

12. The pixel circuit of claim 1, wherein the transistors are p-type transistors.

13. The pixel circuit of claim 1, wherein the light-emitting device is one of an organic light-emitting diode, a micro light-emitting diode (LED), or a quantum dot LED.

14. A method of operating a pixel circuit for a display device comprising the steps of:

providing a pixel circuit comprising:

a drive transistor configured to control an amount of current to a light-emitting device during an emission phase depending upon a voltage applied to a gate of the drive transistor, the drive transistor being electrically connectable to a first voltage supply line that supplies a driving voltage and having a first terminal and a second terminal;

a diode connecting first switch transistor having a first terminal connected to the gate of the drive transistor and a second terminal connected to the first terminal of the drive transistor;

a storage capacitor having a first plate connected to the gate of the drive transistor and a second plate opposite from the first plate; and a light-emitting device that is electrically connected at a first terminal to the first or second terminal of the drive transistor during the emission phase and is connected at a second terminal to a second voltage supply line;

a first compensation capacitor having a first plate connected to a gate of the first switch transistor and a second plate connected to the gate of the drive transistor; and a second compensation capacitor having a first plate connected to the first voltage supply line and a second plate connected to the second terminal of the first switch transistor;

performing a combined threshold compensation and data programming phase to compensate a threshold voltage of the drive transistor and to program a data voltage comprising:

placing the first switch transistor in an on state to diode connect the drive transistor for compensation of a threshold voltage of the drive transistor by electrically connecting the gate and the first terminal of the drive transistor through the first switch transistor; and electrically connecting the second terminal of the drive transistor to a data voltage supply line that supplies a data voltage to apply the data voltage to the second terminal of the drive transistor;

wherein during the combined threshold compensation and data programming phase, the first and second compensation capacitors operate to compensate for threshold voltage variations of the diode connecting first switch transistor; and performing an emission phase during which light is emitted from the light-emitting device comprising:

electrically connecting the drive transistor and the first power supply line; and electrically connecting the first terminal of the light-emitting device and the drive transistor to apply the driving voltage from the first voltage supply line to the light-emitting device through the drive transistor.

15. The method of operating of claim 14, wherein the pixel circuit further comprises a second switch transistor connected to the data voltage supply line, wherein the combined threshold compensation and data programming phase further includes placing the second switch transistor in an on state to electrically connect the drive transistor to the data voltage supply line to supply the data voltage through the second switch transistor.

16. The method of operating of claim 15, further comprising performing an on stress bias phase by placing the second switch transistor in an on state to electrically connect the drive transistor to the data voltage supply line, and applying a bias voltage from the data voltage supply to the drive transistor through the second switch transistor.

17. The method of operating of claim 15, wherein the pixel circuit further includes a third switch transistor having a first terminal connected to the drive transistor and a second terminal connected to the first terminal of the light-emitting device, wherein the emission phase further includes placing the third switch transistor in an on state to electrically connect the first terminal of the light-emitting device to the drive transistor through the third switch transistor.

18. The method of operating of claim 15, further comprising performing an initialization phase including electrically disconnecting the first terminal of the light-emitting device from the first voltage supply line, and electrically connecting the second plate of the storage capacitor to an initialization voltage supply line and applying an initialization voltage to the second plate of the storage capacitor.

19. The method of operating of claim 18, wherein the initialization phase further includes electrically connecting the first terminal of the light-emitting device to the initialization voltage supply line and applying the initialization voltage to the first terminal of the light-emitting device.

20. The method of operating of claim 18, wherein the pixel circuit further includes a third switch transistor connected to the initialization voltage supply line, and the initialization phase includes placing the third switch transistor in an on state and applying the initialization voltage from the initialization voltage supply line through the third switch transistor.

* * * * *